US009656479B2

(12) United States Patent
Ellis

(10) Patent No.: US 9,656,479 B2
(45) Date of Patent: May 23, 2017

(54) MACHINE AND METHOD OF OPERATION

(71) Applicant: VIDEOJET TECHNOLOGIES INC., Wood Dale, IL (US)

(72) Inventor: Jeremy Ellis, Notingham (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 14/901,849

(22) PCT Filed: Oct. 10, 2014

(86) PCT No.: PCT/GB2014/022425
§ 371 (c)(1),
(2) Date: Dec. 29, 2015

(87) PCT Pub. No.: WO2015/059447
PCT Pub. Date: Apr. 30, 2015

(65) Prior Publication Data

US 2016/0368278 A1 Dec. 22, 2016

(30) Foreign Application Priority Data

Oct. 22, 2013 (GB) ..... 1318670.5

(51) Int. Cl.
*B41J 3/407* (2006.01)
*B41J 2/325* (2006.01)

(52) U.S. Cl.
CPC ..... *B41J 3/4075* (2013.01); *B41J 2/325* (2013.01)

(58) Field of Classification Search
None
See application file for complete search history.

(56) References Cited

U.S. PATENT DOCUMENTS 5,795,086 A 8/1998 Watanabe et al.
6,129,462 A 10/2000 Furuya
(Continued)

FOREIGN PATENT DOCUMENTS

EP 1164028 12/2001
EP 1777075 4/2007
(Continued)

*Primary Examiner* — Lisa M Solomon
(74) *Attorney, Agent, or Firm* — Robert L. Wolter; Beusse, Wolter, Sanks & Maire PLLC

(57) ABSTRACT

A labelling machine comprises a first motive apparatus configured to advance a label web along a label web path; an encoder arranged to output a sensor signal which is indicative of a rate of movement of said label web along said label web path; and a printer configured to print on said label web, the printer including a second motive apparatus configured to advance a print ribbon along a ribbon path. The labelling machine further comprises a controller configured to receive said sensor signal and control the second motive apparatus based on the sensor signal. The controller is configured to supply a pulsed control signal to the second motive apparatus, the intervals between pulses of the pulsed control signal being a function of a desired rate of movement of the print ribbon along the ribbon path. The controller is configured such that if the controller is controlling the second motive apparatus to advance the print ribbon at a first rate of movement having a first series of intervals between pulses, and the controller receives said sensor signal being indicative of the label web moving along label web path at a second rate of movement greater than the first, then the controller supplies a re-timed pulse to the second motive apparatus at a time which is before a next pulse defined by the first series of intervals.

16 Claims, 5 Drawing Sheets

(56) References Cited

U.S. PATENT DOCUMENTS

Figure 1:
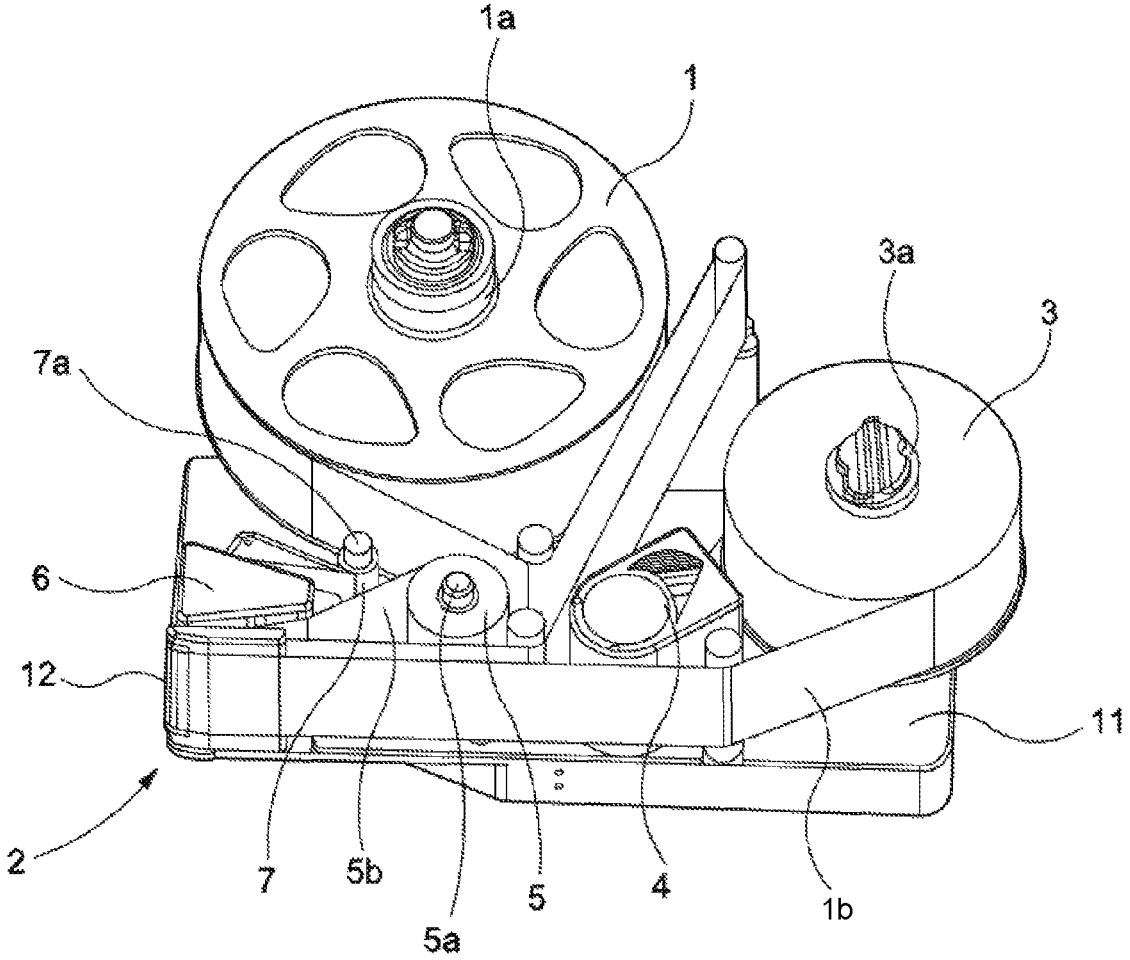

| | | | | |
|---|---|---|---|---|
| 2002/0096262 | A1* | 7/2002 | Yang | B65C 9/1869<br>156/360 |
| 2002/0096264 | A1* | 7/2002 | Yang | B65C 3/14<br>156/556 |

FOREIGN PATENT DOCUMENTS

| | | |
|---|---|---|
| JP | 2004042645 | 2/2004 |
| WO | 9834788 | 8/1998 |
| WO | 0222371 | 3/2002 |

* cited by examiner

MACHINE AND METHOD OF OPERATION

The present invention relates to a labelling machine and particularly to a labelling machine for use with label stock comprising a web and a plurality of labels attached to the web and which are separable from the web. Such machines are sometimes referred to as "roll-fed self-adhesive labelling machines". The present invention also relates to a method of operation of a labelling machine.

A label stock comprising a web carrying labels is usually manufactured and supplied as a wound roll (hereinafter referred to as a spool). For a given spool, all the labels are typically the same size, within manufacturing tolerances. However, in some instances, this is not the case.

Labels are commonly used to display information relating to an article and are commonly disposed on the article such that the information is easily readable either manually or automatically. Such labels may, for example, display product information, barcodes, stock information or the like. Labels may be adhered to a product or to a container in which the product is packaged.

In the manufacturing industry, where such labels are read automatically, it is important for the information to be printed such that it is clear and positioned accurately so that an automated reader can consistently and correctly read the information.

Some known labelling machines apply pre-printed labels to an article. Other known labelling machines print information onto labels immediately before printed labels are applied to an article. Such labelling machines may be referred to as print and apply labelling machines.

It is desirable to be able to advance a web of labels to be applied to an article accurately, so as to ensure that print is accurately positioned on the label and/or to ensure that the label is accurately positioned on the article. This may be particularly important in print and apply labelling machines in which printing is typically carried out while the label moves relative to the printhead, making accurate control of the label (and hence the label stock) important if printing is to be properly carried out such that the desired information is correctly reproduced on the label.

Given that labels are often removed from the moving web by passing the label stock under tension around a labelling peel beak (sometimes referred to as a peel beak, a peel blade or a label separating beak), it is sometimes desirable to ensure that a predetermined optimum tension in the web of the label stock is maintained. In some applications, it is also desirable that the label stock can be moved at a predetermined speed of travel along a defined web path, so as to ensure that the speed at which labels are dispensed is compatible with the speed at which products or containers move along a path adjacent the device.

It is therefore desirable in the manufacturing industry for there to be means and a method for transporting a label stock and applying labels from the web of the label stock to a product or container, which is accurate, reliable, simple to use and adaptable to different applications.

Known print and apply labelling machines include a printer which includes a printhead past which print ribbon is advanced, the printhead being energised to remove ink from the ribbon and transfer it to labels of the label stock as it passes the printhead. Whilst the printer is carrying out a printing operation the print ribbon may be advanced at substantially the same speed as the label stock. Between printing operations the print ribbon may be advanced at a different speed to the label stock or even in the opposite direction. Because of this, as well as being able to accurately control the positioning of the print ribbon, it is also desirable to be able to quickly accelerate the print ribbon—the ability to quickly accelerate the print ribbon facilitates any necessary changes in speed and/or direction in the print ribbon.

In addition, the ability to quickly accelerate the print ribbon may reduce the time it takes to move the print ribbon whilst the labelling machine is operating. This may reduce the amount of time it takes for the labelling machine to print and apply labels, thus advantageously increasing the throughput of the labelling machine.

Known labelling machines include motive apparatus for advancing the print ribbon which operates such that the print ribbon accelerates at a rate which is less than desired. This may result in a reduction in throughput of such a labelling machine.

It is an object of embodiments of the present invention to obviate or mitigate one or more of the problems of known labelling machines whether set out above or otherwise, and/or to provide an alternative labelling machine.

According to an aspect of the present invention there is provided a labelling machine comprising a first motive apparatus configured to advance a label web along a label web path; an encoder arranged to output a sensor signal which is indicative of a rate of movement of said label web along said label web path; and a printer configured to print on said label web, the printer including a second motive apparatus configured to advance a print ribbon along a ribbon path; the labelling machine further comprising a controller configured to receive said sensor signal and control the second motive apparatus based on the sensor signal; wherein the controller is configured to supply a pulsed control signal to the second motive apparatus, the intervals between pulses of the pulsed control signal being a function of a desired rate of movement of the print ribbon along the ribbon path; wherein the controller is configured such that if the controller is controlling the second motive apparatus to advance the print ribbon at a first rate of movement having a first series of intervals between pulses, and the controller receives said sensor signal being indicative of the label web moving along label web path at a second rate of movement greater than the first, then the controller supplies a re-timed pulse to the second motive apparatus at a time which is before a next pulse defined by the first series of intervals.

By retiming the next pulse provided to the second motive apparatus by the controller after the sensor signal provided by the encoder indicates that the label web is moving along label web path at a second rate of movement greater than the first (which may indicate that an increase in the rate of movement of the print ribbon is required), as opposed to waiting the interval defined by the first series of intervals, acceleration of the second motive apparatus (and hence print ribbon) can be achieved more quickly (i.e. in a shorter amount of time) compared to known labelling machines. Consequently, due to the fact that print ribbon can be accelerated to the required rate of movement in less time using a controller according to the present invention, the throughput of a labelling machine including a controller according to the present invention can be increased. Furthermore, the ability to accelerate the print ribbon to a required rate of movement may, in some applications, be advantageous because it may allow acceleration of the print ribbon to more closely match acceleration of the label web.

The first rate of movement of the print ribbon may be a first speed of the ribbon or a first acceleration of the ribbon.

The first rate of movement may be when the ribbon is at rest, i.e. when there is no movement of the ribbon. In this case, the pulsed control signal will not include any pulses. That is to say the first series of intervals between pulses is an infinite interval such that there are no pulses until the second motive apparatus is commanded to move the ribbon.

The second rate of movement of the print ribbon may be a second speed of the ribbon or a second acceleration of the ribbon.

The controller may further be configured to provide a subsequent pulse after the re-timed pulse such the interval between the re-timed pulse and subsequent pulse is an interval which defined by a second series of intervals for the second rate of movement.

The second series of intervals may be a series of different intervals, the length of each interval decreasing as the series advances. This will be the case when the second series of intervals correspond to an acceleration of the second motive apparatus (and hence of the print ribbon).

The second series of intervals may be a series of intervals which are substantially the same. This will be the case when the second series of intervals correspond to an constant speed of the second motive apparatus (and hence of the print ribbon).

Values indicative of the second series of intervals may either be stored in a memory which the controller is configured to access when the controller receives said sensor signal being indicative of the label web moving along label web path at the second rate of movement, or may be calculated by the controller when the controller receives said sensor signal being indicative of the label web moving along label web path at the second rate of movement.

The first series of intervals may be a series of different intervals, the length of each interval decreasing as the series advances. This will be the case when the first series of intervals correspond to an acceleration of the second motive apparatus (and hence of the print ribbon).

The first series of intervals may be a series of intervals which are substantially the same. This will be the case when the second series of intervals correspond to an constant speed of the second motive apparatus (and hence of the print ribbon).

Values indicative of the first series of intervals may either be stored in a memory which the controller is configured to access when movement of the print ribbon along ribbon path at the first rate of movement is required, or may be calculated by the controller when movement of the print ribbon along ribbon path at the first rate of movement is required.

The stored values indicative of the first and/or second series of intervals may take the form of first and/or second acceleration tables. The stored values indicative of the first and/or second series of intervals may be stored in a memory which forms part of the controller or a memory which is separate to the controller.

The second motive apparatus may comprise at least one position controlled motor.

In an embodiment in which the second motive apparatus comprises at least one position controlled motor, the printer may comprise a ribbon supply spool support for supporting a supply spool of ribbon, and a ribbon take up spool support for winding up ribbon advanced along the ribbon path, and wherein each of the ribbon supply spool support and ribbon take up spool supports may be driven for rotation by a respective position controlled motor.

In another embodiment in which the second motive apparatus comprises at least one position controlled motor, the printer may comprise a ribbon supply spool support for supporting a supply spool of ribbon, and a ribbon take up spool support for winding up ribbon advanced along the ribbon path. In this embodiment, only the ribbon take up spool support may be driven for rotation, the ribbon take up spool support being driven for rotation by a position controlled motor.

The or each position controlled motor may be a stepper motor. The or each position controlled motor may be a servo motor, for example a DC servo motor.

The controller may supply said re-timed pulse to the second motive apparatus substantially instantaneously. For example, the controller may supply the re-timed pulse to the second motive apparatus as quickly after the controller receives the sensor signal indicative of the label web moving along label web path at a second rate of movement.

Values indicative of a series of intervals between pulses of the pulsed control signal which correspond to a maximum possible acceleration of the second motive apparatus may be stored in a memory which the controller is configured to access or may be calculated by the controller.

The controller may be configured to compare an interval between pulses of the pulsed control signal which corresponds to the second rate of movement with an interval between pulses of the pulsed control signal which corresponds to the maximum possible acceleration of the second motive apparatus; and if the interval which corresponds to the second rate of movement is less than the interval which corresponds to the maximum possible acceleration of the second motive apparatus, the controller may supply the retimed pulse to the second motive apparatus at a time such that the time elapsed between the retimed pulse and the preceding pulse is substantially equal to the interval which corresponds to the maximum possible acceleration of the second motive apparatus.

The controller may be configured to compare an interval between pulses of the pulsed control signal which corresponds to the second rate of movement with an interval between pulses of the pulsed control signal which corresponds to the maximum possible acceleration of the second motive apparatus; and if the interval which corresponds to the second rate of movement is greater than the interval which corresponds to the maximum possible acceleration of the second motive apparatus, the controller may supply the retimed pulse to the second motive apparatus at a time such that the time elapsed between the retimed pulse and the preceding pulse is substantially equal to the interval which corresponds to the second rate of movement.

According to a second aspect of the invention, there is provided a method of controlling a labelling machine, the labelling machine comprising a first motive apparatus, an encoder, a controller, and a printer, the printer including a second motive apparatus; the method comprising the first motive apparatus advancing a label web along a label web path; the encoder outputting a sensor signal which is indicative of a rate of movement of said label web along said label web path; the second motive apparatus advancing a print ribbon along a ribbon path; the controller receiving said sensor signal and controlling the second motive apparatus based on the sensor signal; the controller supplying a pulsed control signal to the second motive apparatus, the intervals between pulses of the pulsed control signal being a function of a desired rate of movement of the print ribbon along the ribbon path; the controller controlling the second motive apparatus to advance the print ribbon at a first rate of movement having a first series of intervals between pulses; the controller receiving said sensor signal, the sensor signal being indicative of the label web moving along label web path at a second rate of movement greater than the first, the controller supplying a re-timed pulse to the second motive apparatus at a time before a next pulse defined by the first series of intervals.

It will be appreciated that features discussed in the context of one aspect of the invention can be applied to other aspects of the invention. In particular, where features are described as being carried out by the controller in the first aspect of the invention it will be appreciated that such features can be used in combination with and applied in a method according to the second aspect of the invention.

The method of the second aspect of the invention can be carried out in any convenient way. In particular the method may be carried out by a printer controller and such a printer controller is therefore provided by the invention. The controller may be provided by any appropriate hardware elements. For example the controller may be microcontroller which reads and executes instructions stored in a memory, the instructions causing the controller to carry out a method as described herein. Alternatively the controller may take the form of an ASIC of FPGA.

According to another aspect of the invention there is provided a computer program comprising computer readable instructions arranged to carry out a method according to the previous aspect of the invention.

According to a further aspect of the invention there is provided a computer readable medium carrying a computer program according to the previous aspect.

Figure 1A:
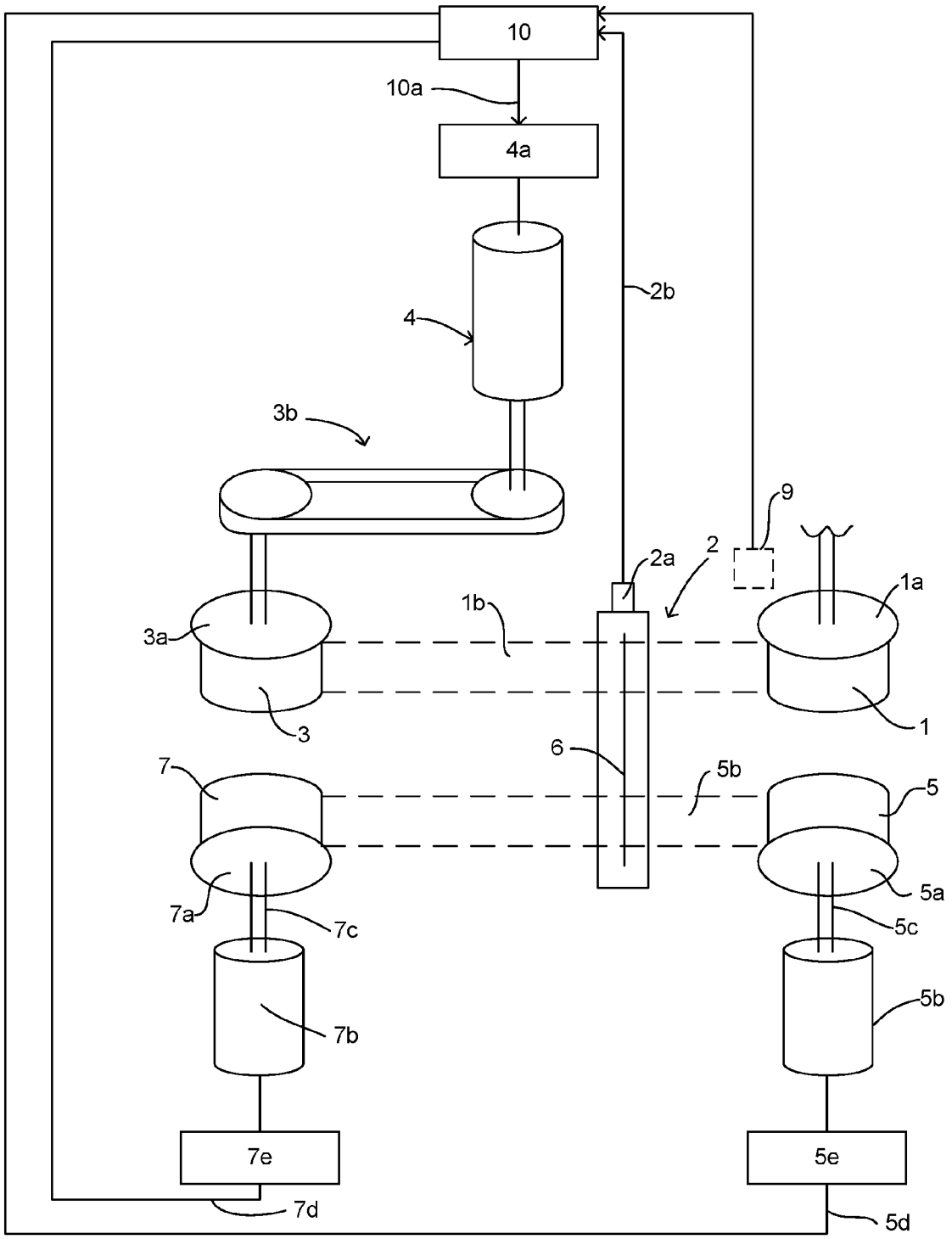
Figures 2A, 2B:
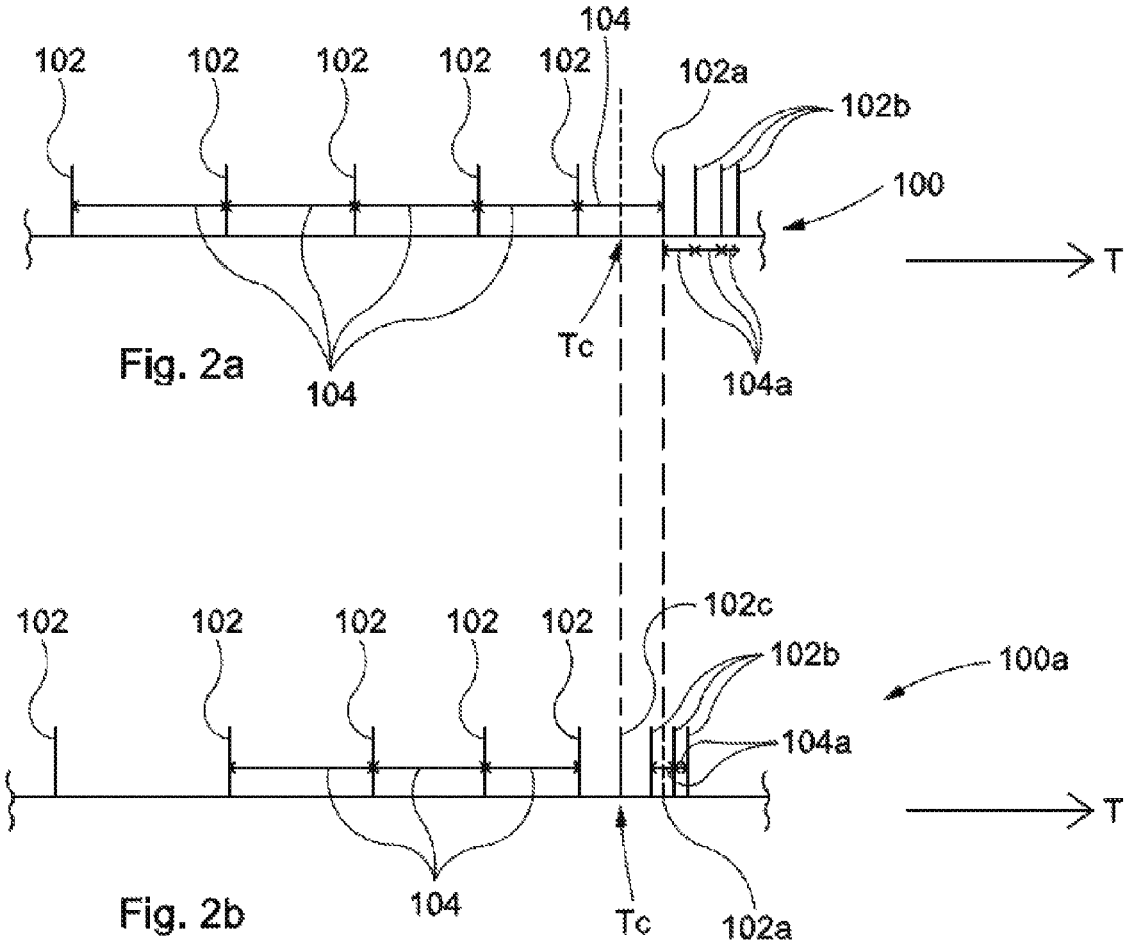
Figure 3:
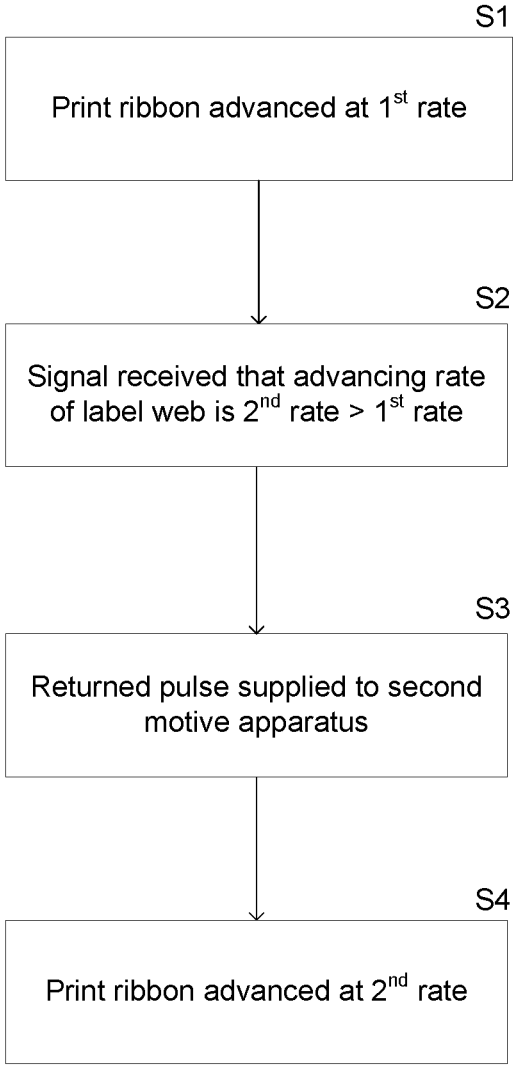
Figure 4:
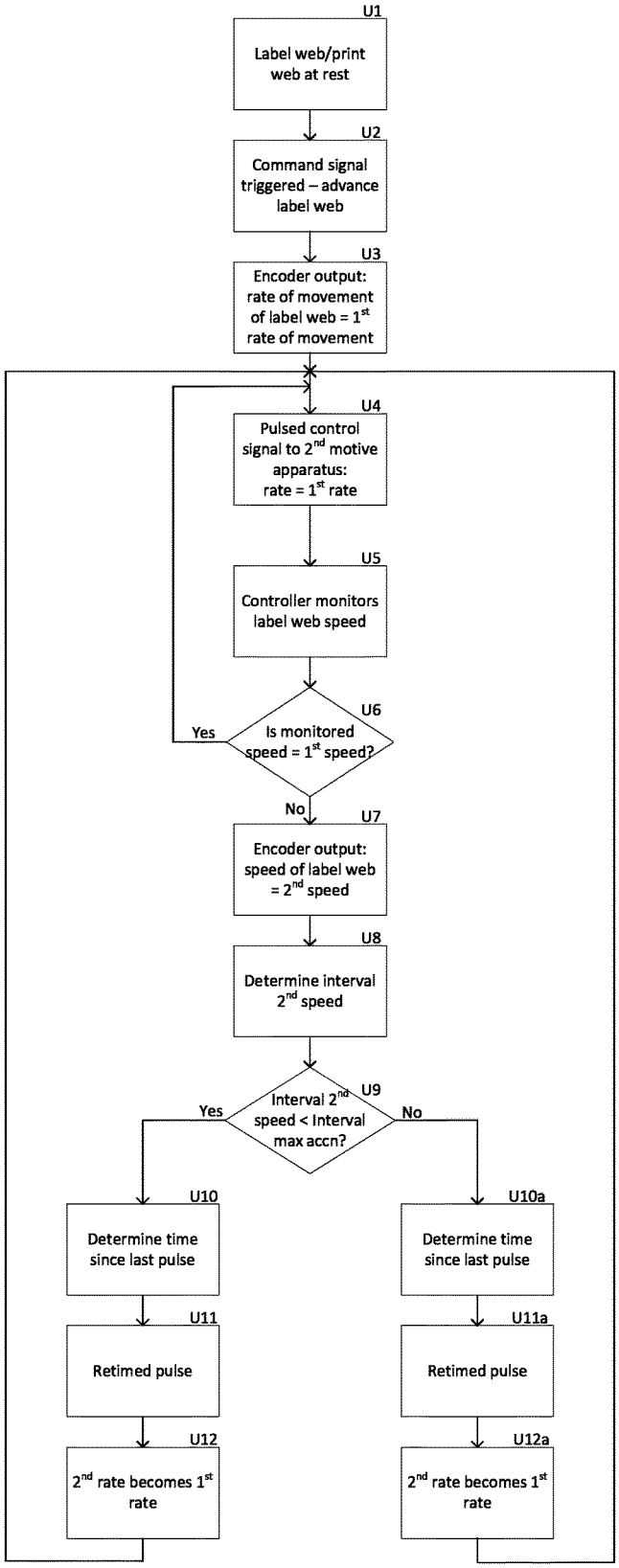

An embodiment of the invention will now be described, by way of example, with reference to the accompanying drawings, in which:

FIG. 1 is a perspective view of a print and apply labelling machine in accordance with the present invention, including a printer;

FIG. 1*a* is a schematic illustration of a portion of the labelling machine shown in FIG. 1;

FIG. 2*a* shows a schematic representation of a portion of a pulsed control signal provided by a controller of a known labelling machine;

FIG. 2*b* shows a schematic representation of a portion of a pulsed control signal provided by a controller of a labelling machine in accordance with an embodiment of the present invention; and FIG. 3 is a schematic flow diagram of steps implemented by a controller of a labelling machine according to an embodiment of the present invention; and FIG. 4 is a schematic flow diagram of steps implemented by a controller of a labelling machine according to a further embodiment of the present invention.

Referring to FIGS. 1 and 1*a*, there is illustrated a print and apply labelling machine in which label web material is provided as a label supply spool 1 supported by a supply spool support 1*a* and is conveyed through a labelling station 2 to a label take up spool 3 supported by a take up spool support 3*a*. The label web material comprises a plurality of labels (not shown) which are affixed to a backing paper (or backing web) and the labelling station is arranged to remove labels from the backing paper such that the labels are affixed to packages which are conveyed past the labelling station 2. The backing paper is then taken up onto the label take up spool 3.

A motor 4 is coupled to the label take up spool 3 via a belt drive 3*b* thereby causing rotation of the take up spool 3 and consequently movement of the label web from the label supply spool 1 to the label take up spool 3 through the labelling station 2.

In the present embodiment the motor 4 constitutes a first motive apparatus for transporting web along a web path between the supply spool support to the take up spool support. For example, in other embodiments the first motive apparatus may take any appropriate form. For example, in some embodiments both the label supply spool 1 and the label take up spool 3 may be driven either by the same motor or by respective motors.

In the present embodiment the motor 4 is a stepper motor. The stepper motor is driven by a stepper motor driver (also referred to as a stepper motor drive circuit) 4*a*, as is well known in the art. A controller 10 may provide a control signal 10*a* to the motor driver 4*a* to control rotation of the stepper motor in a step-wise fashion. In other embodiments the motor(s) driving the label take up spool 3 (and, in some cases, the label supply spool) may be motors other than stepper motors. For example the motor(s) may be direct current (DC) motor(s). In general, the motor(s) may be torque controlled motors (e.g. DC motors) or position controlled motors (e.g. stepper motors, or DC servo motors). In addition, depending on what type of motor(s) is/are used, it would be apparent to the person skilled in the art that an appropriate motor drive control system will be required.

The labelling station 2 includes a thermal transfer printer which is arranged to print on labels of the label web as they pass through the labelling station 2 and before they are removed from the backing paper. Further details of the thermal transfer printer are discussed below.

The label supply spool support, label take up spool support, motor and labelling station are mounted to a baseplate 11.

Ink carrying ribbon 5*b* is provided on a ribbon supply spool 5 which is supported by a ribbon supply spool support 5*a*. The ribbon 5*b* passes a printhead assembly 6 and is taken up by a ribbon take-up spool 7 which is supported by a ribbon take-up spool support 7*a*. The ribbon supply spool 5 is driven by a first stepper motor 5*b* while the ribbon take-up spool 7 is driven by a second stepper motor 7*b*. In the illustrated embodiment the ribbon supply spool support 5*a* is mounted on an output shaft 5*c* of the first stepper motor 5*b*, while the ribbon take-up spool support 7*a* is mounted on an output shaft 7*c* of the second stepper motor 7*b*. The first and second stepper motors 5*b*, 7*b* may be arranged so as to operate in push-pull mode whereby the first stepper motor 5*b* rotates the ribbon supply spool 5 to pay out ribbon while the second stepper motor 7*b* rotates the ribbon take-up spool 7 so as to take up tape. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

In the described embodiment the motors 5*b*, 7*b* form part of a second motive apparatus configured to advance the print ribbon along the ribbon path.

In other embodiments the ribbon may be transported from the ribbon supply spool 5 to the ribbon take up spool 7 passed the printhead assembly 6 in other ways. That is to say, in other embodiments, the second motive apparatus may take any other appropriate form. For example only the ribbon take up spool may be driven by a motor while the ribbon supply spool 5 is arranged so as to provide resistance to ribbon motion, thereby causing tension in the ribbon. That is, the first motor driving the ribbon supply spool 5 may not be required in some embodiments. In some embodiments the motors driving the ribbon supply spool 5 and the ribbon take up spool 7 may be motors other than stepper motors. For example the motors driving the ribbon supply spool 5 and the ribbon take up spool 7 may be direct current (DC)

motors. In general the motors driving the ribbon supply spool 5 and/or the ribbon take up spool 7 may be torque controlled motors (e.g. DC motors) or position controlled motors (e.g. stepper motors, or DC servo motors).

The printhead assembly 6 comprises a printhead (not shown) which presses the ribbon 5*a* and label web 1*b* against a print roller (not shown) to effect printing. The printhead is a thermal transfer printhead comprising a plurality of printing elements, each arranged to remove a pixel of ink from the ribbon and to deposit the removed pixel of ink on a substrate (in this case labels which form part of the label web).

The labelling station 2 is configured to separate labels of the label web from the backing web as the label web passes the labelling station. The separated labels may then be applied to an article which passes the labelling machine. In this embodiment the labelling station includes a labelling peel beak 12. The labelling peel beak 12 is configured such that, during operation of the labelling machine, as the label web 1*b* is transported along the web path past the labelling peel beak 12, the labelling peel beak 12 separates passing labels of the label web 1*b* from the backing web. In other embodiments the labelling peel beak may be replaced by any appropriate component configured to separate passing labels of the label web from the backing web.

The labelling machine also includes an encoder 2*a* which is arranged to output a sensor signal 2*b* which is indicative of a rate of movement of the label web along the label web path. The rate of movement of the label web may be a speed of the label web, an acceleration of the label web, an amount of movement of the label web during a given time, or the time taken for the label web to move a predetermined distance along the web path. In some embodiments, the determination of a rate of movement of the label web along the label web path may be made by a controller 10 to which the sensor signal 2*b* is provided. In other embodiments, the determination of a rate of movement of the label web along the label web path may be made by the encoder itself and a signal indicative thereof provided to the controller. The rate of movement of the label web may be a speed of the label web, an acceleration of the label web, an amount of movement of the label web during a given time, or the time taken for the label web to move a predetermined distance along the web path.

In this particular embodiment the encoder monitors rotation of the print roller. In some embodiments the print roller comprises an aluminium shaft of diameter 8 mm and is coated with a non-slip coating. In one embodiment, the non-slip coating is a silicon rubber coating having a Shore A hardness of 50-55 and a thickness of 2.75 mm. The primary purpose of the print roller is to provide a backing support against which the printhead presses the ribbon and label web so as to effect thermal transfer printing onto a label. As such, the print roller acts as platen roller. The provision of a non-slip coating has the effect of ensuring that there is substantially no slippage between the print roller and the label web. Consequently, the print roller rotates consistently as the label web moves along the web path. This means that the rotation of the print roller is an accurate indicator of label web movement. Rotation of the print roller may be used in processing carried out by the controller in order to determine a rate of movement of the label web in the manner described below.

In some embodiments the diameter of the print roller is known to the controller. In one embodiment the print roller has a diameter of 13.5 mm. It is preferable that the print roller has as small a moment of inertia as possible, and it is for this reason that the shaft is made from aluminium. Because the diameter of the print roller is known, and because the label web runs over the print roller as the label web passes through the printer, the amount of rotation of the print roller is proportional to the displacement of the label web along the label web path. Consequently, a sensor signal output by the encoder, which is indicative of the amount of rotation of the print roller, may be supplied to a controller such that the controller can determine the displacement of the label web along the label web path and, consequently, the rate of movement of the label web along the label web path.

In one particular embodiment the encoder which measures the rotation of the print roller comprises a magnet (part number BMN-35H which is marketed by Bomatec, KM, Switzerland) which is mounted to the end of the print roller such that it co-rotates with the print roller, and an encoder chip (part number AMS5040, marketed by ams R&D UK Ltd) which measures rotation of the magnet and hence print roller, and outputs a signal which is representative thereof. As discussed above, this output can be used by the controller to determine the rate of movement of the label web along the label web path.

Although the encoder in this embodiment measures a rotation of the printer roller in order to output a sensor signal which is indicative of a rate of movement of the label web along the label web path, in other embodiments this need not be the case. Any appropriate encoder which is capable of outputting a sensor signal which is indicative of a rate of movement of the label web along the label web path may be used. For example, an encoder which measures the rotation of a different roller which contacts the label web may be used.

In other embodiments, the encoder may measure a property of the label stock which is periodic in order to provide a sensor signal which is indicative of a rate of movement of a label web along the label web path. For example, the encoder may use a gap sensor (shown in broken lines and indicated as 9 in FIG. 1*a*) to measure the amount of electromagnetic radiation (e.g. light) which passes through a portion of the label web (this will be a function of the electromagnetic transmission coefficient of the label web). The label backing web in general has a greater electromagnetic transmission coefficient than a label attached to the label backing web. It follows that, in general, more electromagnetic radiation will pass through a portion of the label web which does not include a label (i.e. a portion of the label web which only includes the label backing web) compared to a portion of the label web which includes both the label backing web and a label attached to the label backing web. Consequently, as the label web advances along the label web path, the gap sensor will measure a periodic property of the label web (I.e. periodic electromagnetic transmission coefficient of the label web). If a pitch length of the labels (i.e. the distance between equivalent portions of adjacent labels) is known by the controller then the controller can use this information to calculate a rate of movement of the label web along the label web path based on the periodic encoder signal.

Furthermore, in further embodiments, the rotation of the label supply spool and/or label take up spool may be measured by the encoder, and this information, in combination with knowledge of the diameter of the respective supply spool and/or take up spool may be used to determine a rate of movement of the label web along the label web path.

Within the present embodiment the motors 7*b*, 5*b* which drive the print ribbon take up spool 7 and print ribbon supply spool 5 may be considered to form part of a second motive apparatus configured to advance the print ribbon along the print ribbon path. In other embodiments any other motive apparatus may be used to advance the print ribbon along the print ribbon path. For example, in some embodiments the second motive apparatus may take the form of a motor arranged to drive only the take up spool support (i.e. the supply spool support may not be driven).

The controller 10 is configured to receive the sensor signal 2*b* which is outputted by the encoder 2*a* and control the second motive apparatus based on the sensor signal 2*b*.

The motors 5*b*, 7*b* which rotate the ribbon supply spool 5 and ribbon take up spool 7 are each position controlled motors. In particular, each motor is a stepper motor. It will be appreciated that in other embodiments any appropriate type of motor may be used. If a motor is a position controlled motor, any type of position controlled motor may be used.

In order to advance the print ribbon along the ribbon path the controller 10 provides a pulsed control signal to the second motive apparatus. In the case, as illustrated, where a second motive apparatus includes two stepper motors 5*b*, 7*b*, one for rotating each of the ribbon supply spool 5 and ribbon take up spool 7, the pulsed control signal provided to the second motive apparatus by the controller may be two separate pulsed control signals 5*d*, 7*d* which trigger a respective stepper motor drive circuit 5*e*, 7*e* for each of the stepper motors to advance the stepper motors 5*b*, 7*b* in a step-wise fashion. The use of stepper motor drive circuits in order to drive stepper motors in a step-wise fashion is well known and hence will not be discussed in any more detail here. Of course, in embodiments in which the second motive apparatus includes only a single stepper motor, the pulsed control signal provided to the second motive apparatus by the controller may be a single pulsed control signal which triggers a stepper motor drive circuit for the stepper motor to advance the stepper motor in a step-wise fashion.

A known way for controllers to control position control motors such as stepper motors is for the controller to provide a pulsed control signal to the position controlled motor.

The nature of the pulsed control signal may be defined by the intervals between each of the pulses. For example a series of intervals between pulses may be a series of different intervals, the length of each interval decreasing as the series advances. A pulsed control signal comprising such a series of intervals between pulses may be used by the controller to accelerate the position control motors in a desired manner. Conversely, a pulsed control signal comprising a series of intervals between pulses in which the length of each interval increases as the series advances may be used by the controller to decelerate the position control motor(s) in a desired manner.

For example, if a controller needs to control the position controlled motor so as to effect an acceleration between a first speed and a second speed, the controller may access information stored in a memory which contains data indicative of the series of intervals of the pulsed control signal which corresponds to acceleration between said first speed and said second speed and apply the intervals between pulses stored in the memory so as to achieve the desired acceleration of the motor between the first and second speeds.

These known labelling machines which incorporate controllers which operate in the manner described above suffer from a common problem. This is discussed in relation to FIG. 2*a*.

FIG. 2*a* shows a schematic view of a portion of a pulsed control signal 100 against time T which is provided by a controller of a known labelling machine to a motive apparatus for advancing the print ribbon. If a particular acceleration is required between the first and second speeds then data indicative of the series of intervals of the pulsed control signal which corresponds to acceleration between said first speed and said second speed is used. As previously discussed, this entails the controller providing a pulsed control signal 100 to the motive apparatus based on data stored in the memory. The pulsed control signal 100 includes pulses 102, the pulses having different intervals 104 between them. There is a decreasing length of interval 104 between the pulses 102 as the pulsed signal (and hence series of pulses) advances because the motive apparatus is being accelerated (i.e. the speed of the motive apparatus is increasing). This is because in this embodiment, the greater the pulse rate of the pulsed control signal, the greater the speed of the motive apparatus.

However, in some known labelling machines, if the controller is subsequently provided with information (for example due to an encoder signal) at a point in time indicated by $T_C$ that acceleration is now not required between a first and second speeds, but between first and third speeds (where the third speed is greater than the second speed), then the controller supplies the next pulse 102*a* after point in time $T_C$ based on the intervals 104 stored within the memory for acceleration between the first and second speeds. Once the next pulse 102*a* has been provided by the controller, the controller accesses data indicative of the series of intervals of the pulsed control signal which corresponds to acceleration between said first speed and said third speed and subsequently provides pulses to the motive apparatus based on the data stored in the memory relating to acceleration between the first and third speeds. The pulses based on the data stored in the memory relating to acceleration between the first and third speeds are indicated as 102*b* and the intervals between adjacent pulses are indicated as 104*a*. Again, there is a decreasing length of interval 104*a* between the pulses 102*b* as the pulsed signal (and hence series of pulses) advances because the motive apparatus is being accelerated (i.e. the speed of the motive apparatus is increasing).

The applicant has realised that known controllers which operate in the manner described above, operate such that there is a delay in the controller providing a suitable control signal to the motive apparatus in order to effect the greater rate of movement of the ribbon required. This delay is caused by the controller waiting to supply the pulse 102*a* to the motive apparatus after the point in time $T_C$ the controller becomes aware that greater acceleration is required based on the interval defined by the series of intervals which corresponds to acceleration between the first and second rates of movement, before the controller changes the interval between the pulses of the control signal which corresponds to the acceleration required between the first and third rates of movement. This delay in changing between the pulse intervals for acceleration between the first and second rates of movement, and the pulse intervals for acceleration between the first and third rates of movement results in the print ribbon being accelerated by the motive apparatus in a delayed fashion. That is to say, the delay in accelerating the motive apparatus and hence the print ribbon results in a given acceleration of the print ribbon taking a longer time than necessary. This may result in a reduced throughput of the labelling apparatus as previously discussed. In some applications, the delay in accelerating the motive apparatus may result in difficulty for the acceleration of the print ribbon to match acceleration of the label web.

A labelling machine including a controller configured according to the present invention seeks to obviate or mitigate this problem.

The operation of a controller 10 of a labelling machine according to an embodiment of the present invention is illustrated with reference to the schematic flow diagram shown in FIG. 3.

At step S1, the controller 10 is controlling the second motive apparatus to advance the print ribbon 5*b* at a first rate of movement having a first series of intervals between pulses. At step S2 the controller 10 receives a sensor signal 2*b* from the encoder 2*a* which is indicative of the label web 1*a* moving along the label web path at a second rate of movement (greater than the first rate of movement), then the controller 10 acts so as to try to increase the rate of movement of the print ribbon in order to substantially match the rate of movement of the label web as measured by the encoder.

A reason why, in some embodiments, it may be desirable for the rate of movement of the print ribbon to substantially match the rate of movement of the label web may be because the speed of the print ribbon along the ribbon path should substantially match the speed of the label web along the label web path such that there is substantially no slippage between the label web and print ribbon when the label web and print ribbon pass the print head during a printing operation, resulting in an acceptable quality of print.

FIG. 2*b* shows a schematic view of a portion of a pulsed control signal 100*a* against time T which is provided by a controller of a labelling machine according to an embodiment of the present invention to a motive apparatus for advancing the print ribbon.

The pulsed control signal 100*a* differs from the pulsed control signal 100 of a known labelling machine as follows. The controller receives at time $T_C$ a sensor signal from the encoder which indicates that the label web is moving at a second rate of movement which is greater than the first rate of movement. The controller of the known labelling machine supplies the next pulse 102*a* after point in time $T_C$ based on the intervals 104 stored within the memory for acceleration between the first and second speeds. Once the next pulse 102*a* has been provided by the controller, the controller subsequently provides pulses to the motive apparatus having a second series of intervals 104*a* therebetween based on the data stored in the memory relating to acceleration between the first and third speeds.

To the contrary, after the controller of the labelling machine according to the present invention receives at time $T_C$ (during step S2), a sensor signal from the encoder which indicates that the label web is moving at a second rate of movement which is greater than the first rate of movement, the controller does not supply the next pulse 102*a* after point in time $T_C$ based on the intervals 104 stored within the memory for acceleration between the first and second speeds. Instead, at step S3, the controller supplies a retimed pulse 102*c* to the second motive apparatus at a time before which is before a next pulse (indicated in broken line within FIG. 2*b* as 102*a*) defined by the first series of intervals.

That is to say, that the controller does not wait until the next pulse 102*a* defined by the first series of intervals is provided by the controller.

The pulses 102*b* supplied by the controller after the retimed pulse 102*c* during step S4, have intervals 104*a* between them which are defined by said second series of intervals based on the data stored in the memory relating to the second rate of movement. More particularly, the subsequent pulse after the re-timed pulse 102*c* is such that the interval between the re-timed pulse 102*c* and subsequent pulse is an interval which is defined by the second series of intervals for the second rate of movement.

In some embodiments the controller may be configured such that it supplies the retimed pulse to the second motive apparatus substantially instantaneously. That is to say, the controller supplies said retimed pulse for the second motive apparatus (step S3) at substantially the same time that the controller receives said sensor signal from the encoder (step S2) which is indicative of the label web travelling at a second speed which is greater than the first speed (and hence the requirement for the print ribbon to be accelerated to a speed which is substantially the same as the speed of the label web as indicated by the encoder).

It will be appreciated that within the specification terms "substantially instantaneously" and "substantially at the same time as" refer to events being cotemporal when ignoring any delay which may be inherent to the speed at which the controller is capable of processing and acting upon the sensor signal provided by the encoder.

However, in some embodiments, the controller may supply the retimed pulse to the second motive apparatus at a time which is shortly after when the controller receives the sensor signal from the encoder which indicates that the labels stock is advancing at the second rate of movement. For example, the controller may receive the sensor signal from the encoder indicating that that speed of the label web is greater than the first speed (at step S2) and then wait a predetermined amount of time before providing the retimed pulsed to the second motive apparatus (at step S3). However, in this situation the retimed pulse still occurs at a time which is before a next pulse defined by the first series of intervals.

By retiming the next pulse provided to the second motive apparatus by the controller after the sensor signal provided by the encoder which indicates that an increase in the rate of movement of the print ribbon is required, as opposed to waiting the interval defined by the first series of intervals, acceleration of the second motive apparatus (and hence print ribbon) can be achieved more quickly (i.e. in a shorter amount of time compared to known labelling machines). Consequently, due to the fact that print ribbon can be accelerated to the required rate of movement in less time using a controller according to the present invention, the throughput of a labelling machine including a controller according to the present invention can be increased. Furthermore, the ability to accelerate the print ribbon to a required rate of movement may, in some applications, be advantageous because it may allow acceleration of the print ribbon to more closely match acceleration of the label web.

Within the previously described embodiment, information relating to the first and second series of intervals which correspond to respective first and second rates of motion may be stored within a memory as respective acceleration tables. Each acceleration table may contain values which are indicative of the intervals within a particular series of intervals. For example, each acceleration table may contain values which are indicative of the series of intervals between pulses which, when supplied to the second motive apparatus results in an acceleration of the second motive apparatus from a speed A to a speed B. In this way, if the controller is required to carry out acceleration of the second motive apparatus from speed A to speed B, the controller can access the acceleration table relating to acceleration from speed A to speed B from the memory and supply a pulsed control signal to the second motive apparatus which has intervals defined by the acceleration table, to thereby achieve the required acceleration of the second motive apparatus.

The information relating to the first and second series of intervals, which may take the form of appropriate acceleration tables, may in some embodiments be stored within a memory of the controller. In other embodiments the information may be stored within a storage means connected to, but separate from the controller. Finally, in some embodiments, the information may be calculated by the controller on-the-fly based on the first and second rates of movement between which acceleration of the second motive apparatus is required.

A general description has been provided above as to how the invention is carried out such that if the controller receives a sensor signal indicative of the label web moving along the label web path at a second rate of movement greater than the first, then the controller supplies a re-timed pulse to the second motive apparatus at a time which is before a next pulse defined by the first series of intervals. A more detailed discussion of a specific embodiment of the invention is described below with reference to a schematic flow diagram shown in FIG. 4.

In this embodiment, at step U1 the label web and print ribbon are substantially at rest. At step U2 a command signal is triggered which causes the controller to energise the first motive apparatus to advance the label web along the label web path in order to carry out a labelling operation.

The command signal may be triggered by any appropriate event. In some embodiments, the labelling machine may include an article sensor which is configured to detect the presence of an article at a location which indicates that the article requires labelling by the labelling machine. The article sensor may be configured to provide a signal to the controller that an article to be labelled by the labelling machine is present and thereby trigger the command signal.

At step U3, which occurs after the first motive apparatus has begun to accelerate the label web so that it advances along the label web path, the encoder outputs a sensor signal which is indicative of the label web moving along the label web path at a first speed.

Based on the controller receiving the sensor signal outputted by the encoder which indicates that the label web is moving at a first speed, at step U4, the controller provides a pulsed control signal to the second motive apparatus to advance the print ribbon along the ribbon path at a speed which substantially matches that of the label web—i.e. the first speed. It will be appreciated that, as previously discussed, the intervals between the pulses of the pulsed control signal supplied to the second motive apparatus by the controller are a function of the desired rate of movement of the print ribbon (i.e. first speed) along the ribbon path.

At step U5 the controller monitors the sensor signal output by the encoder so as to monitor the speed of the label web along the label web path.

At step U6 the controller assesses whether the monitored sensor signal output by the encoder is still indicative of the label web travelling at the first speed. If so, then the controller returns to step U4 of the flow diagram. If not, processing advances to step U7.

The controller may include a memory or be configured to access a memory which stores a maximum acceleration table. The maximum acceleration table contains information which is indicative of the intervals between pulses of the pulsed control signal which is supplied to the second motive apparatus by the controller which correspond to the maximum possible acceleration that the second motive apparatus can undertake in order to accelerate the ribbon along the ribbon path. For example, the maximum acceleration table may contain information which is indicative of the intervals between pulses of the pulsed control signal which correspond to the maximum possible acceleration of the second motive apparatus without the second motive apparatus stalling and therefore becoming un-useable. The controller may, in some embodiments, determine a speed associated with each interval in the maximum acceleration table which corresponds to the speed of the second motive apparatus as defined by the respective interval between two pulses of the pulsed control signal.

The maximum rate of acceleration of the second motive apparatus, and hence the information contained within the maximum acceleration table, may be dependent upon various factors. For example, the maximum rate of acceleration may depend upon the diameters of the ribbon supply and ribbon take-up spools. Furthermore, the maximum acceleration may be dependent upon operating characteristics of the second motive apparatus. For this reason, in some embodiments, the maximum acceleration for a given second motive apparatus may be determined empirically for different diameters of ribbon take-up spool and supply spool. This information may then be stored within a look-up table stored in a memory of the controller or a memory accessible to the controller such that the controller can look up the maximum acceleration possible for a particular combination of diameters of ribbon take-up spool and ribbon supply spool.

There are many known ways to determine the diameters of spools. Any appropriate method may be used. Consequently, no further detail as to ribbon spool diameter determination is provided.

Once the controller has looked up what the maximum possible acceleration for a particular combination of ribbon supply spool diameter and ribbon take-up spool diameter the controller may use this information to calculate the maximum acceleration table which corresponds to the maximum possible acceleration of the second motive apparatus. That is to say, the controller may determine the intervals between the pulses of the pulsed control signal which may be supplied to the second motive apparatus which will result in the second motive apparatus (and hence ribbon) accelerating at the maximum possible acceleration.

In other embodiments, the controller may not need to determine the maximum possible acceleration based on the diameters of the spools of print ribbon so as to produce the maximum acceleration table. Instead, in some embodiments, the controller may access information stored in a memory of the controller or a memory accessible to the controller which contains a pre-calculated maximum acceleration table for different diameters of ribbon supply spool and ribbon take-up spool.

It will be appreciated that, during operation of the labelling machine, as a result of the diameters of the print ribbon supply spool and print ribbon take-up spool changing, the maximum acceleration table for the second motive apparatus will change throughout the operation of the labelling machine.

The label web continues to be accelerated by the first motive apparatus such that at step U7 the encoder outputs a sensor signal which is indicative of the label web moving along the label web path at a second rate of movement which is greater than the first.

At step U8 the controller determines the time interval between pulses of the pulsed control signal supplied to the second motive apparatus which corresponds to the second rate of movement of the label web along the label web path.

At step U9 the controller determines whether the interval between pulses of the pulsed control signal which is required to control the second motive apparatus so as to advance the ribbon along the ribbon path at the second rate of movement is shorter than the interval defined by the maximum acceleration table (in this case the first entry in the maximum acceleration table because the ribbon is accelerated by the second motive apparatus from rest). If this is the case then processing advances to step U10 if it is not the case, processing advances to step U10A.

At step U10 the controller determines the amount of time that has passed since the last pulse of the pulsed control signal that was issued by the controller. At U11 the controller supplies a re-timed pulse to the second motive apparatus at the time when the time elapsed since the last pulse after the pulsed control signal is equal to the interval defined by the maximum acceleration table. It will be appreciated that this re-timed pulse will be supplied to the second motive apparatus at a time which is before a next pulse defined by the first series of intervals which correspond to the first rate of movement of the label web along the label web path. That is to say, when the controller receives a sensor signal which indicates that the label web is travelling at a rate of movement which is greater than the current rate of movement of the print ribbon, the controller does not wait to allow the controller to issue the next pulse of the pulsed control signal based upon an interval between pulses which corresponds to the first rate of movement, but rather re-times the next pulse of the pulsed control signal such that the interval between the last pulse of the pulsed control signal and the next pulse of the pulsed control signal is equal to the interval defined by the maximum acceleration table.

By ensuring that an interval from the maximum acceleration table is used (as opposed to the interval defined by the second speed of the label web) this ensures that the second motive apparatus (and hence the print ribbon) is not accelerated to an extent which may extend beyond the capabilities of the second motive apparatus.

At step U12 the second rate of movement becomes the first rate of movement and processing returns to step U4.

As previously discussed, if at step U9 it is determined that the interval between pulses of the pulsed control signal which is supplied to the second motive apparatus which corresponds to the second rate of movement of the label web along the label web path measured by the encoder is greater than the interval defined by the maximum acceleration table, then processing passes to step U10A.

At step U10A the controller determines the time that has elapsed since the last pulse of the pulsed control signal.

At step U11A the controller supplies a re-timed pulse to the second motive apparatus at the time when the duration since the last pulse of the pulsed control signal is equal to the interval between pulses of the pulsed control signal which corresponds to the second motive apparatus advancing the ribbon along the ribbon web path at the second rate of movement. Again, it will be appreciated that this re-timed pulse will be supplied to the second motive apparatus at a time which is before a next pulse defined by the first series of intervals which correspond to the first rate of movement of the label web along the label web path. That is to say, when the controller receives a sensor signal which indicates that the label web is travelling at a rate of movement which is greater than the current rate of movement of the print ribbon, the controller does not wait to allow the controller to issue the next pulse of the pulsed control signal based upon an interval between pulses which corresponds to the first rate of movement, but rather re-times the next pulse of the pulsed control signal such that the interval between the last pulse of the pulsed control signal and the next pulse of the pulsed control signal is equal to the interval required for the second motive apparatus to advance the ribbon along the ribbon path at the sensed greater rate of movement.

At step U12A the second rate of movement becomes the first rate of movement and processing returns to step U4.

In some embodiments, if at step U3 the encoder outputs a sensor signal which is indicative of the label web moving along the label web path at a first speed which is greater than a speed which corresponds to at least one of the intervals of the maximum acceleration table, the controller may provide a pulsed control signal to the second motive apparatus which has the series of intervals defined by the maximum acceleration table, until the controller has implemented a pulse which has an interval between it and the preceding pulse which is the interval of the maximum acceleration table which is one interval before that interval of the maximum acceleration table which corresponds to a speed which is greater than the first speed.

It will be appreciated that in some embodiments of the invention the controller may be configured such that the provision of a retimed pulse may occur, when satisfying the conditions described anywhere above, at any point during the operation of the labelling machine. In other embodiments the controller may be configured such that the provision of a retimed pulse may occur, when satisfying the conditions described anywhere above, only when the ribbon is accelerated from rest. In a further embodiment, the controller may be configured such that the provision of a retimed pulse may occur, when satisfying the conditions described anywhere above, only whilst the retimed pulse is the pulse which is less than or equal to a predetermined number of pulses since the ribbon was at rest. The predetermined number may be 1 or 2. This is because it has been found that the benefit of providing a retimed pulse to the second motive apparatus in order to accelerate the second motive apparatus (and hence ribbon) more quickly, in order to attempt to match the movement of the label web more closely, is greatest at the beginning of acceleration of the second motive apparatus (and hence ribbon) from rest. This is because at the beginning of acceleration of the second motive apparatus (and hence ribbon) from rest the intervals between pulses are relatively long and hence a retimed pulse can save a relatively large amount of time by preventing the controller from having to wait the full interval before providing the next pulse.

Various features of the labelling machine have been described above. In some cases, exemplary components, configurations and methods suitable for realising these particular features have been described. However in many cases the skilled person will know of other components, configurations and methods which can similarly be used to realise the particular features which are described. Many of these components, configurations and methods will be known to the skilled person from the common general knowledge. It is envisaged that such alternative components, configurations and methods can be implemented in the described embodiments without difficulty given the disclosure presented herein.

While references have been made herein to a controller or controllers it will be appreciated that control functionality described herein can be provided by one or more controllers. Such controllers can take any suitable form. For example control may be provided by one or more appropriately programmed microprocessors (having associated storage for program code, such storage including volatile and/or non volatile storage). Alternatively or additionally control may be provided by other control hardware such as, but not limited to, application specific integrated circuits (ASICs) and/or one or more appropriately configured field programmable gate arrays (FPGAs).

Where angles have been specified herein, such angles are measured in radians although modifications to use other angular measurements will be apparent to the skilled person.

While various embodiments of labelling machine(s) have been described herein, it will be appreciated that this description is in all respects illustrative, not restrictive. Various modifications will be apparent to the skilled person without departing from the spirit and scope of the invention.

The invention claimed is:

1. A labelling machine comprising:

a first motive apparatus configured to advance a label web along a label web path;

an encoder arranged to output a sensor signal which is indicative of a rate of movement of said label web along said label web path; and a printer configured to print on said label web, the printer including a second motive apparatus configured to advance a print ribbon along a ribbon path;

the labelling machine further comprising a controller configured to receive said sensor signal and control the second motive apparatus based on the sensor signal; and wherein the controller is configured to supply a pulsed control signal to the second motive apparatus, the intervals between pulses of the pulsed control signal being a function of a desired rate of movement of the print ribbon along the ribbon path;

wherein the controller is configured such that if the controller is controlling the second motive apparatus to advance the print ribbon at a first rate of movement having a first series of intervals between pulses, and the controller receives said sensor signal being indicative of the label web moving along label web path at a second rate of movement greater than the first, then the controller supplies a re-timed pulse to the second motive apparatus at a time which is before a next pulse defined by the first series of intervals.

2. A labelling machine according to claim 1, wherein the controller is further configured to provide a subsequent pulse after the re-timed pulse such the interval between the re-timed pulse and subsequent pulse is an interval which is defined by a second series of intervals for the second rate of movement.

3. A labelling machine according to claim 2, wherein the second series of intervals is a series of different intervals, the length of each interval decreasing as the series advances.

4. A labelling machine according to claim 3, wherein values indicative of the second series of intervals are either stored in a memory which the controller is configured to access when the controller receives said sensor signal being indicative of the label web moving along label web path at the second rate of movement, or calculated by the controller when the controller receives said sensor signal being indicative of the label web moving along label web path at the second rate of movement.

5. A labelling machine according to claim 1, wherein the first series of intervals is a series of different intervals, the length of each interval decreasing as the series advances.

6. A labelling machine according to claim 5, wherein values indicative of the first series of intervals are either stored in a memory which the controller is configured to access when movement of the print ribbon along ribbon path at the first rate of movement is required, or calculated by the controller when movement of the print ribbon along ribbon path at the first rate of movement is required.

7. A labelling machine according to claim 1 wherein the second motive apparatus comprises at least one position controlled motor.

8. A labelling machine according claim 7, wherein the printer comprises a ribbon supply spool support for supporting a supply spool of ribbon, and a ribbon take up spool support for winding up ribbon advanced along the ribbon path, and wherein each of the ribbon supply spool support and ribbon take up spool supports are driven for rotation by a respective position controlled motor.

9. A labelling machine according to any of claim 7, wherein the printer comprises a ribbon supply spool support for supporting a supply spool of ribbon, and a ribbon take up spool support for winding up ribbon advanced along the ribbon path, and wherein only the ribbon take up spool support is driven for rotation, the ribbon take up spool support being driven for rotation by a position controlled motor.

10. A labelling machine according to claim 8, wherein the or each position controlled motor is a stepper motor.

11. A labelling machine according to claim 1 wherein the controller supplies said re-timed pulse to the second motive apparatus substantially instantaneously.

12. A labelling machine according to claim 1, wherein values indicative of a series of intervals between pulses of the pulsed control signal which correspond to a maximum possible acceleration of the second motive apparatus are either stored in a memory which the controller is configured to access or calculated by the controller.

13. A labelling machine according to claim 12, wherein the controller is configured to compare an interval between pulses of the pulsed control signal which corresponds to the second rate of movement with an interval between pulses of the pulsed control signal which corresponds to the maximum possible acceleration of the second motive apparatus; and if the interval which corresponds to the second rate of movement is less than the interval which corresponds to the maximum possible acceleration of the second motive apparatus, supply the a re-timed pulse to the second motive apparatus at a time such that the time elapsed between the retimed pulse and the preceding pulse is substantially equal to the interval which corresponds to the maximum possible acceleration of the second motive apparatus.

14. A labelling machine according to claim 12, wherein the controller is configured to compare an interval between pulses of the pulsed control signal which corresponds to the second rate of movement with an interval between pulses of the pulsed control signal which corresponds to the maximum possible acceleration of the second motive apparatus; and if the interval which corresponds to the second rate of movement is greater than the interval which corresponds to the maximum possible acceleration of the second motive apparatus, supply the a re-timed pulse to the second motive apparatus at a time such that the time elapsed between the retimed pulse and the preceding pulse is substantially equal to the interval which corresponds to the second rate of movement.

15. A method of controlling a labelling machine, the labelling machine comprising:

a first motive apparatus, an encoder, a controller, and a printer, the printer including a second motive apparatus;

the method comprising:

the first motive apparatus advancing a label web along a label web path;

the encoder outputting a sensor signal which is indicative of a rate of movement of said label web along said label web path;

the second motive apparatus advancing a print ribbon along a ribbon path;

the controller receiving said sensor signal and controlling the second motive apparatus based on the sensor signal;

the controller supplying a pulsed control signal to the second motive apparatus, the intervals between pulses of the pulsed control signal being a function of a desired rate of movement of the print ribbon along the ribbon path;

the controller controlling the second motive apparatus to advance the print ribbon at a first rate of movement having a first series of intervals between pulses;

the controller receiving said sensor signal, the sensor signal being indicative of the label web moving along label web path at a second rate of movement greater than the first, the controller supplying a re-timed pulse to the second motive apparatus at a time before a next pulse defined by the first series of intervals.

16. A non-transitory computer readable medium carrying processor readable instructions operable to cause a processor to carry out the operations of:

receiving a sensor signal and controlling a second motive apparatus based on a sensor signal;

supplying a pulsed control signal to the second motive apparatus, the intervals between pulses of the pulsed control signal being a function of a desired rate of movement of a print ribbon along a ribbon path;

controlling the second motive apparatus to advance the print ribbon at a first rate of movement having a first series of intervals between pulses;

receiving said sensor signal, the sensor signal being indicative of the label web moving along label web path at a second rate of movement greater than the first, supplying a re-timed pulse to the second motive apparatus at a time before a next pulse defined by the first series of intervals;

wherein:

the second motive apparatus is configured to advance a print ribbon of a printer along a ribbon path; and the sensor signal is output by an encoder, the sensor signal being indicative of a rate of movement of a label web along a label web path, said label web being advanced along a label web path by a first motive apparatus.

* * * * *